US012398011B2

(12) United States Patent
Egawa et al.

(10) Patent No.: US 12,398,011 B2
(45) Date of Patent: Aug. 26, 2025

(54) POSTPROCESSING DEVICE THAT FORMS AIR LAYER BETWEEN UPPER FACE OF SHEETS ALREADY STACKED ON PROCESSING TRAY AND LOWER FACE OF SHEET NEWLY PLACED ON PROCESSING TRAY, AND IMAGE FORMING SYSTEM

(71) Applicant: KYOCERA Document Solutions Inc., Osaka (JP)

(72) Inventors: Keisuke Egawa, Osaka (JP); Terumitsu Noso, Osaka (JP); Yasunori Ueno, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 220 days.

(21) Appl. No.: 18/109,518

(22) Filed: Feb. 14, 2023

(65) Prior Publication Data

US 2023/0264492 A1 Aug. 24, 2023

(30) Foreign Application Priority Data

Feb. 21, 2022 (JP) ..... 2022-024999

(51) Int. Cl.
*B65H 29/24* (2006.01)

(52) U.S. Cl.
CPC ... *B65H 29/246* (2013.01); *B65H 2301/4461* (2013.01)

(58) Field of Classification Search
CPC ..... B65H 29/249; B65H 2301/4461
See application file for complete search history.

(56) References Cited

U.S. PATENT DOCUMENTS 10,781,066 B2 * 9/2020 Kishimoto ..... B65H 37/06
2005/0220521 A1 10/2005 Kuwata et al.
2008/0203653 A1 8/2008 Kuwata et al.

FOREIGN PATENT DOCUMENTS

JP 2011001197 A 1/2011

* cited by examiner

*Primary Examiner* — Howard J Sanders
(74) *Attorney, Agent, or Firm* — IP Business Solutions, LLC.

(57) ABSTRACT

A postprocessing device is attached to an image forming apparatus. The postprocessing device includes a processing tray, a sheet processor, and a fan. The processing tray is for stacking thereon sheets on which an image has been formed and which is transported from the image forming apparatus. The sheet processor performs predetermined postprocessing on the sheets stacked on the processing tray. The fan forms an air layer between an upper face of the sheets already stacked on the stacking surface of the processing tray and a lower face of a sheet newly placed on the processing tray, by emitting air in a transport direction of the sheet, from an upstream side in the transport direction toward the stacking surface.

5 Claims, 7 Drawing Sheets

POSTPROCESSING DEVICE THAT FORMS AIR LAYER BETWEEN UPPER FACE OF SHEETS ALREADY STACKED ON PROCESSING TRAY AND LOWER FACE OF SHEET NEWLY PLACED ON PROCESSING TRAY, AND IMAGE FORMING SYSTEM

INCORPORATION BY REFERENCE

This application claims priority to Japanese Patent Application No. 2022-024999 filed on Feb. 21, 2022, the entire contents of which are incorporated by reference herein.

BACKGROUND

The present disclosure relates to a postprocessing device that performs postprocessing on a plurality of sheets, and an image forming system that includes such postprocessing device.

In an image forming apparatus, an image reading device reads the image of a source document, and an image forming device forms the image of the source document on a recording sheet. The postprocessing device receives the recording sheet having the image of the source document formed thereon from the image forming apparatus, and performs postprocessing on the recording sheet. The postprocessing performed by the postprocessing device includes, for example, a stapling operation including aligning the edges of a plurality of recording sheets and binding the edge of the sheaf of the recording sheets, a punching operation for perforating the end portion of the recording sheet, and an inward folding operation for folding the recording sheet.

The postprocessing device includes a processing tray for stacking and temporarily retaining the recording sheets thereon. The postprocessing device performs predetermined postprocessing, on the recording sheets stacked on the processing tray. For example, a postprocessing device is known that includes a tray for temporarily retaining following recording sheets (second intermediate storage section), located on the upper side of the processing tray (first intermediate storage section).

SUMMARY

The disclosure proposes further improvement of the foregoing techniques.

In an aspect, the disclosure provides a postprocessing device to be attached to an image forming apparatus. The postprocessing device includes a processing tray, a sheet processor, and a fan. The processing tray is for stacking thereon sheets on which an image has been formed and which is transported from the image forming apparatus. The sheet processor performs predetermined postprocessing on the sheets stacked on the processing tray. The fan forms an air layer between an upper face of the sheets already stacked on the stacking surface of the processing tray and a lower face of a sheet newly placed on the processing tray, by emitting air in a transport direction of the sheet, from an upstream side in the transport direction toward the stacking surface.

In another aspect, the disclosure provides an image forming system including an image forming apparatus and a postprocessing device. The image forming apparatus forms an image on a sheet. The postprocessing device receives the sheet from the image forming apparatus, and performs postprocessing on the sheet. The postprocessing device includes a processing tray, a sheet processor, and a fan. The processing tray is for stacking thereon sheets transported from the image forming apparatus. The sheet processor performs predetermined postprocessing on the sheets stacked on the processing tray. The fan forms an air layer between an upper face of the sheets already stacked on the stacking surface of the processing tray and a lower face of a sheet newly placed on the processing tray, by emitting air in a transport direction of the sheet, from an upstream side in the transport direction toward the stacking surface.

DETAILED DESCRIPTION

Figure 1:
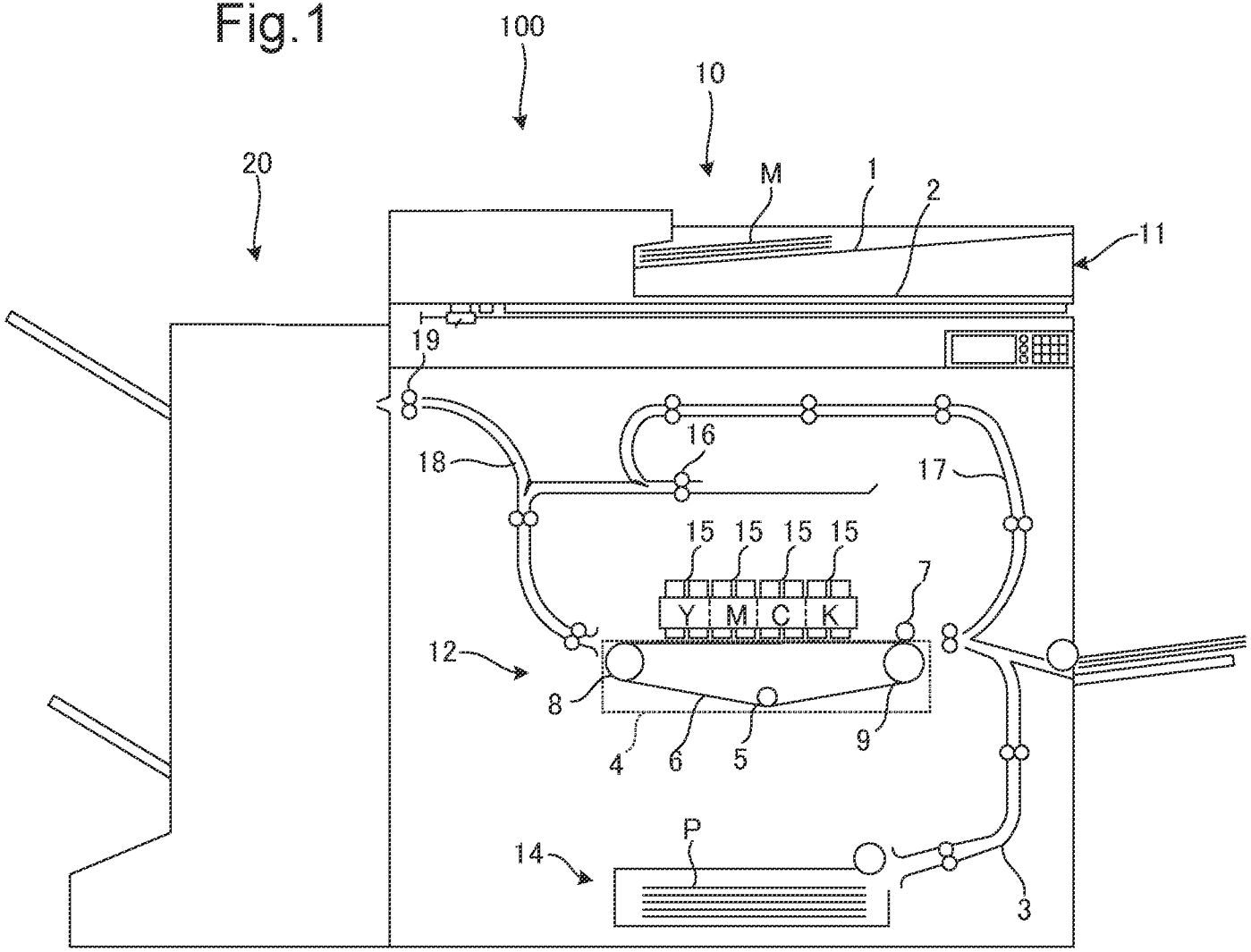
FIG. 1 is a partially cross-sectional front view of an image forming system including a postprocessing device according to an embodiment of the disclosure.

Hereafter, a postprocessing device and an image forming system according to an embodiment of the disclosure will be described, with reference to the drawings. FIG. 1 is a partially cross-sectional front view of the image forming system including the postprocessing device according to the embodiment of the disclosure. The image forming system 100 includes an image forming apparatus 10 that reads an image of a source document and forms the image on a recording sheet (exemplifying the sheet in the disclosure), and the postprocessing device 20 that receives the recording sheet from the image forming apparatus 10, and performs postprocessing on the recording sheet.

The image forming apparatus 10 is a multifunction peripheral having a plurality of functions, such as copying, printing, scanning, and facsimile transmission. The image forming apparatus 10 includes an image reading device 11 and an image forming device 12. When a plurality of source documents M are placed on a document tray 1, the image reading device 11 sequentially draws out the source documents M from the document tray 1 one by one, reads the image of each of the source documents M with an image sensor, and sequentially delivers the source documents M to the discharge tray 2, so as to stack on each other. The image reading device 11 converts the analog output from the image sensor to a digital signal, and generates image data representing the image of each of the source documents M.

The image forming device 12 forms the image of the source document M represented by the image data, on the recording sheet P through an ink jet process, each time the image data representing the image of each of the source documents M is inputted. The image forming device 12 includes line heads 15 (exemplifying the ink head in the disclosure) that respectively eject ink of four colors, namely black, cyan, magenta, and yellow. The line heads 15 each eject the ink droplets of the corresponding color onto the recording sheet P, delivered to a conveying unit 4 from a paper feeding device 14 through a first transport route 3, thereby forming a color image on the recording sheet P.

The conveying unit 4 includes a drive roller 8, a follower roller 9, tension roller 5, and a transport belt 6. The transport belt 6 is an endless belt stretched around the drive roller 8, the follower roller 9, and the tension roller 5. The drive roller 8 is driven by a motor so as to rotate counterclockwise in FIG. 1. When the drive roller 8 is made to rotate, the transport belt 6 revolves counterclockwise in FIG. 1, and the follower roller 9 and the tension roller 5 are each passively made to rotate counterclockwise in FIG. 1, by the transport belt 6.

The tension roller 5 serves to maintain the tension of the transport belt 6 at an appropriate level. The transport belt 6 is in contact with an adsorption roller 7. The adsorption roller 7 electrically charges the transport belt 6, to thereby electrostatically adsorb the recording sheet P delivered from the paper feeding device 14, to the transport belt 6.

A controller 66 of the image forming apparatus 10 (FIG. 5), to be subsequently described, causes the image forming device 12 to form the image of the source document M on the recording sheet P, and transports the recording sheet P to the postprocessing device 20, through a relay transport route 18 and a delivery roller 19. In this case, the controller 66 transports the recording sheet P with the face on which the image of the source document M has been formed oriented upward, in other words in a face-up orientation, to the postprocessing device 20.

When the recording sheet P is to be delivered to the postprocessing device 20 with the face on which the image of the source document M has been formed oriented downward, in other words in a face-down orientation, the controller 66 performs switchback transport, including transporting the recording sheet P from the relay transport route 18 to the transport roller 16, once stopping the transport roller 16 and then reversely rotating the same, and returning the recording sheet P to the conveying unit 4 through a second transport route 17, thereby inverting the front and back faces of the recording sheet P. Then the controller 66 transports such recording sheet P to the postprocessing device 20, through the relay transport route 18 and the delivery roller 19.

When the image of the source document M is also to be formed on the back face of the recording sheet P, the controller 66 performs the switchback transport, to return the recording sheet P to the conveying unit 4 through the second transport route 17, in the inverted orientation. Then the controller 66 causes the image forming device 12 to form the image of the source document M on the back face of the recording sheet P, and transports the recording sheet P to the postprocessing device 20, through the relay transport route 18 and the delivery roller 19.

Figure 2:
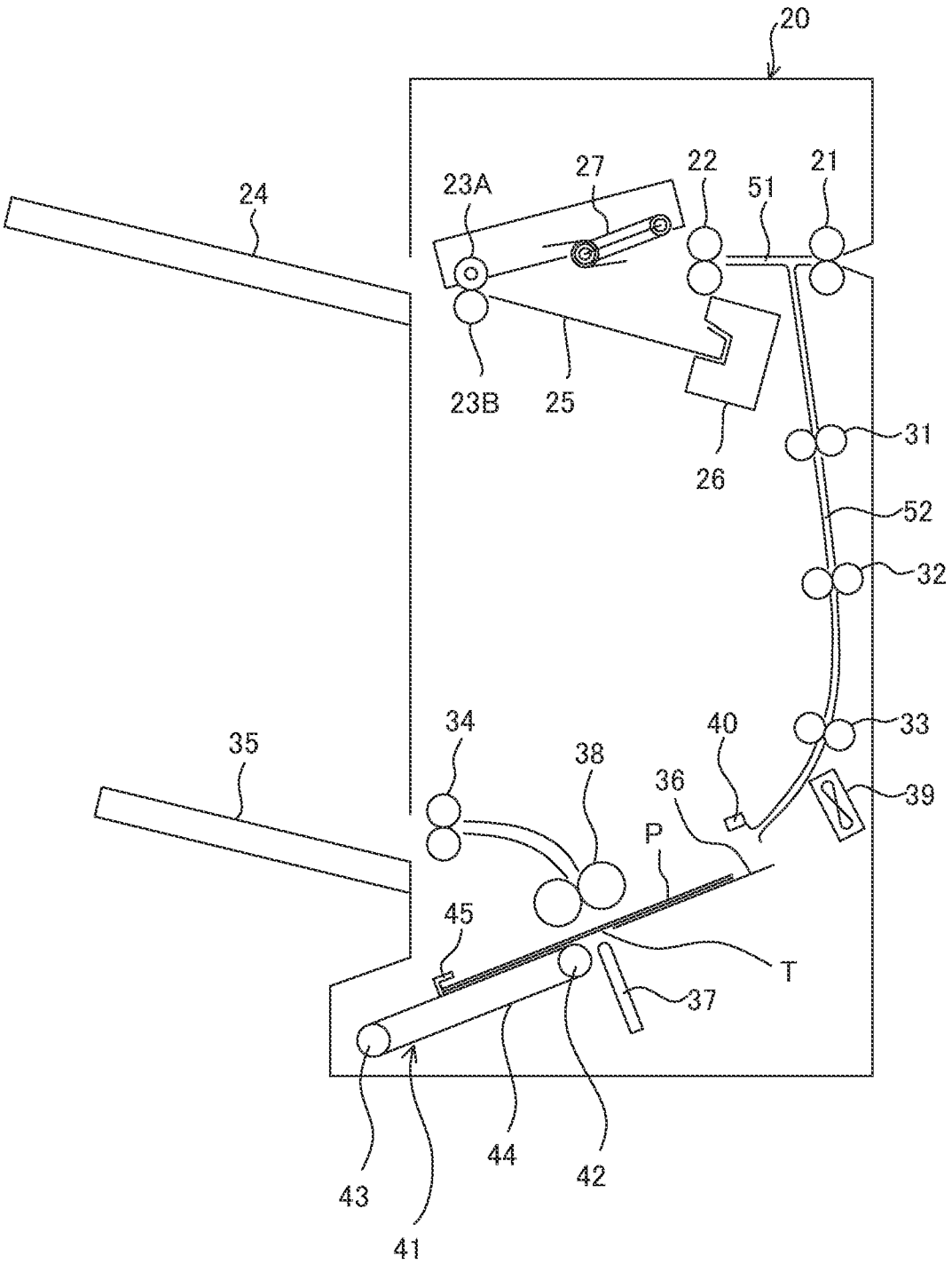
FIG. 2 is an enlarged and partially cross-sectional front view of the postprocessing device.

FIG. 2 is a partially cross-sectional front view of the postprocessing device 20. The postprocessing device 20 includes, in the upper area thereof, two transport roller pairs 21 and 22, a pair of delivery rollers 23A and 23B, an output tray 24, a processing tray 25, a stapling device 26, and a paddle 27. The processing tray 25 is for stacking and temporarily retaining thereon the recording sheets P. The stapling device 26 serves to bind the end portion of a plurality of recording sheets P stacked on the processing tray 25.

The postprocessing device 20 includes, in the middle area thereof toward the lower side, three transport roller pairs 31 to 33, a delivery roller pair 34, an output tray 35, a processing tray 36, a blade 37, a folding roller pair 38, a fan 39, and a sheet sensor 40. The processing tray 36 is for stacking and temporarily retaining thereon the recording sheets P. The blade 37 and the folding roller pair 38 inwardly fold the recording sheet P placed on the processing tray 36. The blade 37 and the folding roller pair 38 exemplify the sheet processor in the disclosure.

Figure 5:
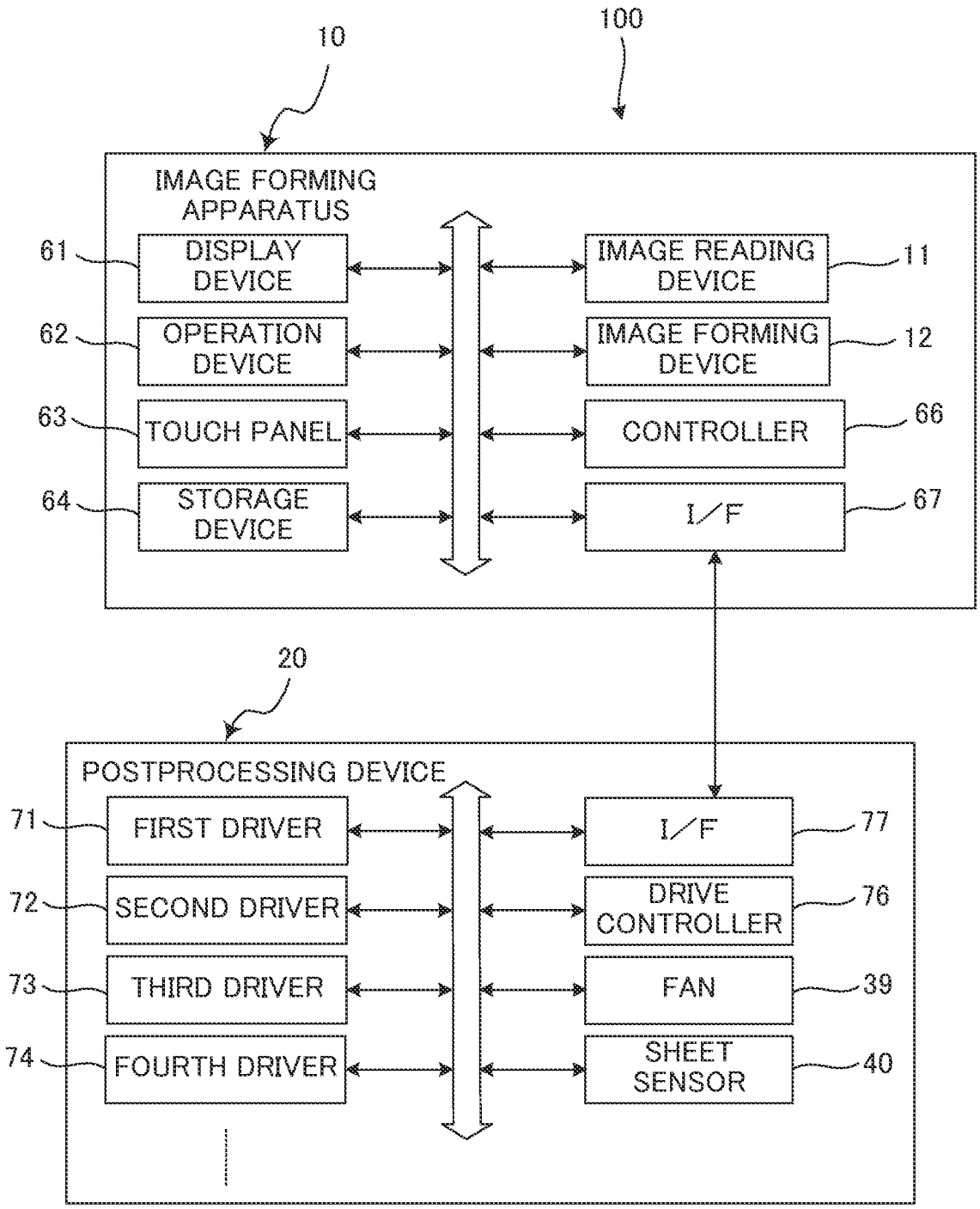
FIG. 5 is a functional block diagram schematically showing an essential internal configuration of an image forming apparatus and the postprocessing device.

The blade 37 is driven by a first driver 71 shown in FIG. 5, for example constituted of a motor, so as to vertically reciprocate with respect to the recording sheet P placed on the processing tray 36. In the processing tray 36, a clearance T is formed for the blade 37 pass through. The processing tray 36 includes a belt moving mechanism 41 for moving the recording sheet P placed on the processing tray 36. The belt moving mechanism 41 includes a drive roller 42, a follower roller 43, a moving belt 44, and a bent piece 45.

The moving belt 44 is an endless belt stretched around the drive roller 42 and the follower roller 43. The drive roller 42 is driven by a motor so as to rotate. When the drive roller 42 is made to rotate, the moving belt 44 revolves. To be more specific, the drive roller 42 is driven by a second driver 72 shown in FIG. 5, for example constituted of a motor, so as to rotate clockwise or counterclockwise in FIG. 2.

The moving belt 44 pushes up the recording sheet P placed on the processing tray 36 to the upstream side in the transport direction, by revolving clockwise in FIG. 2. The moving belt 44 pulls back the recording sheet P placed on the processing tray 36 to the downstream side in the transport direction, by revolving counterclockwise in FIG. 2. The bent piece 45 is located on the outer circumferential surface of the moving belt 44. The bent piece 45 is bent toward the upstream side in the transport direction, to prevent the leading edge of the recording sheet P placed on the processing tray 36 from falling off.

At the branch point between the transport roller pair 21 and the transport roller pairs 22 and 31, a flap to be made to swing, by a driver such as a motor, is provided. A drive controller 76 of the postprocessing device 20, to be subsequently described, causes the flap to swing, so as to deliver the recording sheet P transported from the image forming apparatus 10, either to the output tray 24 on the left in FIG. 2, through a third transport route 51, or to the output tray 35, on the lower side in FIG. 2, through a fourth transport route 52.

The fan 39 emits air in the transport direction of the recording sheet P, from the upstream side in the transport direction toward the stacking surface of the processing tray 36, thereby forming an air layer between the upper face of the recording sheet P already placed on the stacking surface of the processing tray 36, and the lower face of the recording sheet P newly placed on the processing tray 36. On the processing tray 36, the recording sheet P is placed at the position that exempts the trailing edge of the recording sheet P placed on the stacking surface from being directly hit by the air emitted from the fan 39. In other words, the processing tray 36 is located at such a position that, when a maximum number of recording sheets P that can be subjected to the operation of the blade 37 and the folding roller 38 are stacked, the lower face of the air layer formed by the fan 39 is located higher than the upper face of the uppermost sheet of the stacked recording sheets P.

The sheet sensor 40 detects the leading edge of the recording sheet P transported through the fourth transport route 52. The sheet sensor 40 is, for example, an optical reflective sensor having a light emitting element that emits light toward the recording sheet P, and a photodetector that receives the light reflected by the recording sheet P.

[When Delivering Recording Sheet P to Output Tray 24]

The drive controller 76 of the postprocessing device 20 transports the recording sheet P delivered from the image forming apparatus 10 through the third transport route 51 using the two transport roller pairs 21 and 22, and then delivers the recording sheet P to the output tray 24, through the delivery rollers 23A and 23B. Alternatively, the drive controller 76 can receive the recording sheet P delivered from the image forming apparatus 10 on the processing tray 25, cause the stapling device 26 to bind the end portion of the plurality of recording sheets P stacked on the processing tray 25, and then deliver the sheaf of the recording sheets P bound as above, from the processing tray 25 to the output tray 24, through the delivery rollers 23A and 23B.

[When Delivering Recording Sheet P to Output Tray 35]

Figure 3A:
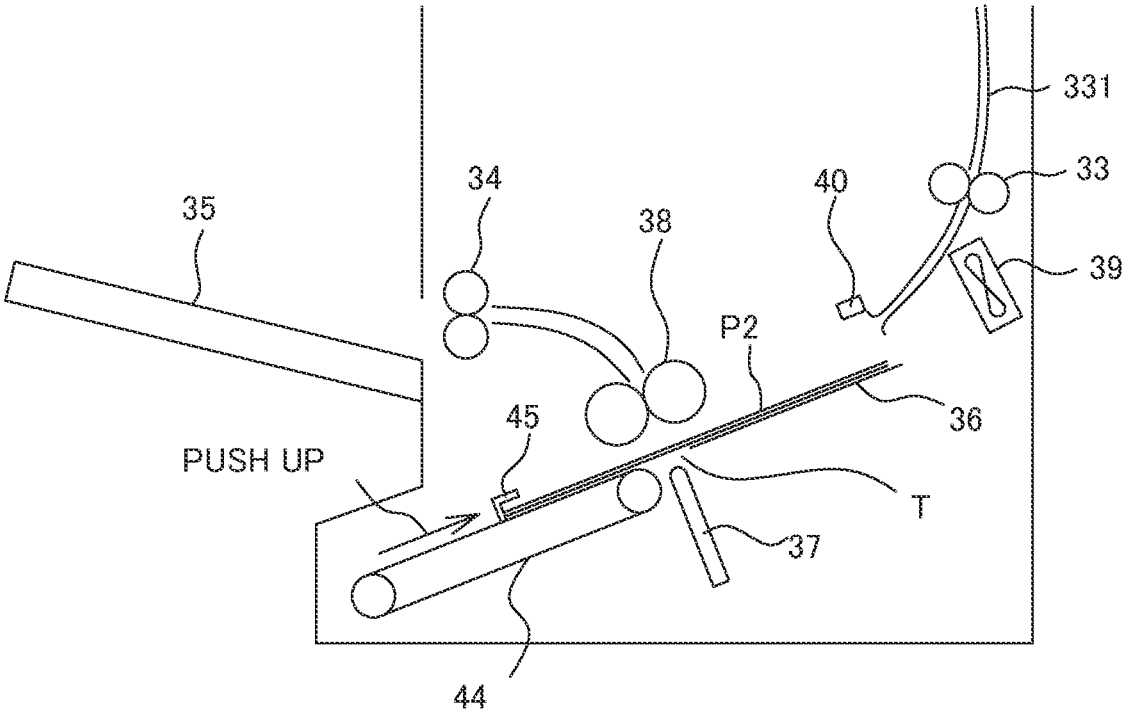
FIG. 3A and FIG. 3B are schematic cross-sectional views each showing how a recording sheet is placed on a processing tray located in a lower portion of the device.

The drive controller 76 of the postprocessing device 20 transports the recording sheet P delivered from the image forming apparatus 10 through the fourth transport route 52, using the three transport roller pairs 31 to 33, and receives the recording sheet P discharged from the fourth transport route 52 on the processing tray 36. Then the drive controller 76 of the postprocessing device 20 causes the moving belt 44 to revolve clockwise as shown in FIG. 3A, thereby pushing up the recording sheet P placed on the processing tray 36 to the upstream side in the transport direction, to a predetermined position.

The predetermined position is defined such that the leading edge of the recording sheet P1 discharged from the fourth transport route 52 can be kept from contacting the trailing edge of the recording sheet P2 placed on the processing tray 36, and that the air emitted from the fan 39 does not directly hit the trailing edge of the recording sheet P2. The position to which the air is emitted from the fan 39 is defined such that the air does not directly hit the trailing edge of the recording sheet P2 which has reached the predetermined position, for example on the upper side of the uppermost sheet of the maximum number of recording sheets P that the processing tray 36 can accept, and on the downstream side of the trailing edge of the recording sheet P2, in the transport direction.

It is for the purpose of preventing the leading edge of the recording sheet P1 from being caught by the trailing edge of the recording sheet P2 and disabled from proceeding further, or preventing the trailing edge of the recording sheet P2 from being lifted up, that the recording sheet P placed on the processing tray 36 is moved to the position where the trailing edge of the recording sheet P2 is kept from contacting the leading edge of the recording sheet P1 discharged from the fourth transport route 52.

Figure 3B:
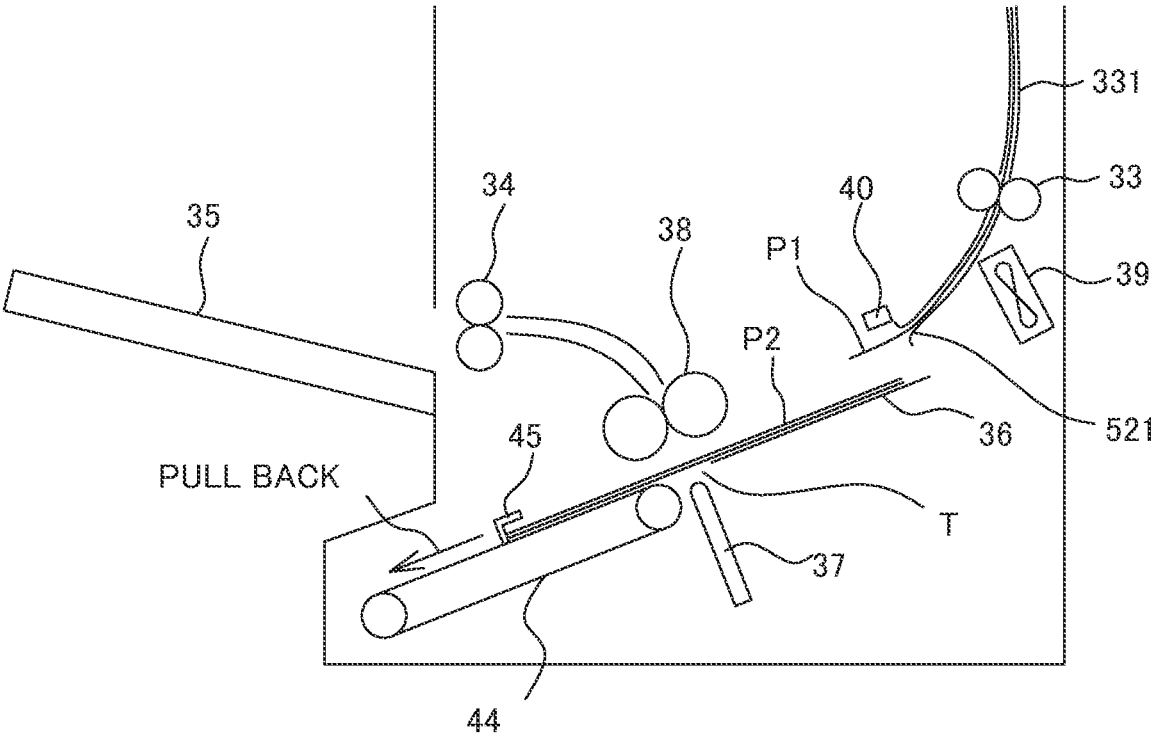

When the recording sheet P1 is discharged from the fourth transport route 52 and placed on the processing tray 36, the drive controller 76 causes the moving belt 44, as shown in FIG. 3B, to revolve counterclockwise, thereby gradually pulling back the recording sheet P placed on the processing tray 36 toward the downstream side in the transport direction, to the position shown in FIG. 2.

The drive controller 76 of the postprocessing device 20 moves the sheaf of the recording sheets P placed on the processing tray 36 using the moving belt 44, so as to bring the position to be folded in the sheaf of the recording sheets P to the clearance T. Then the drive controller 76 moves the blade 37, so that the blade 37 pushes up the sheaf of the recording sheets P, into a mountain fold shape. The drive controller 76 causes the folding roller pair 38 to catch the mountain fold shape portion of the sheaf of the recording sheets P, and to transport the sheaf of the recording sheets P in the folded state, so that the folded sheaf of the recording sheets P is delivered to the output tray 35, from the processing tray 36 through the delivery roller 34.

Figure 4:
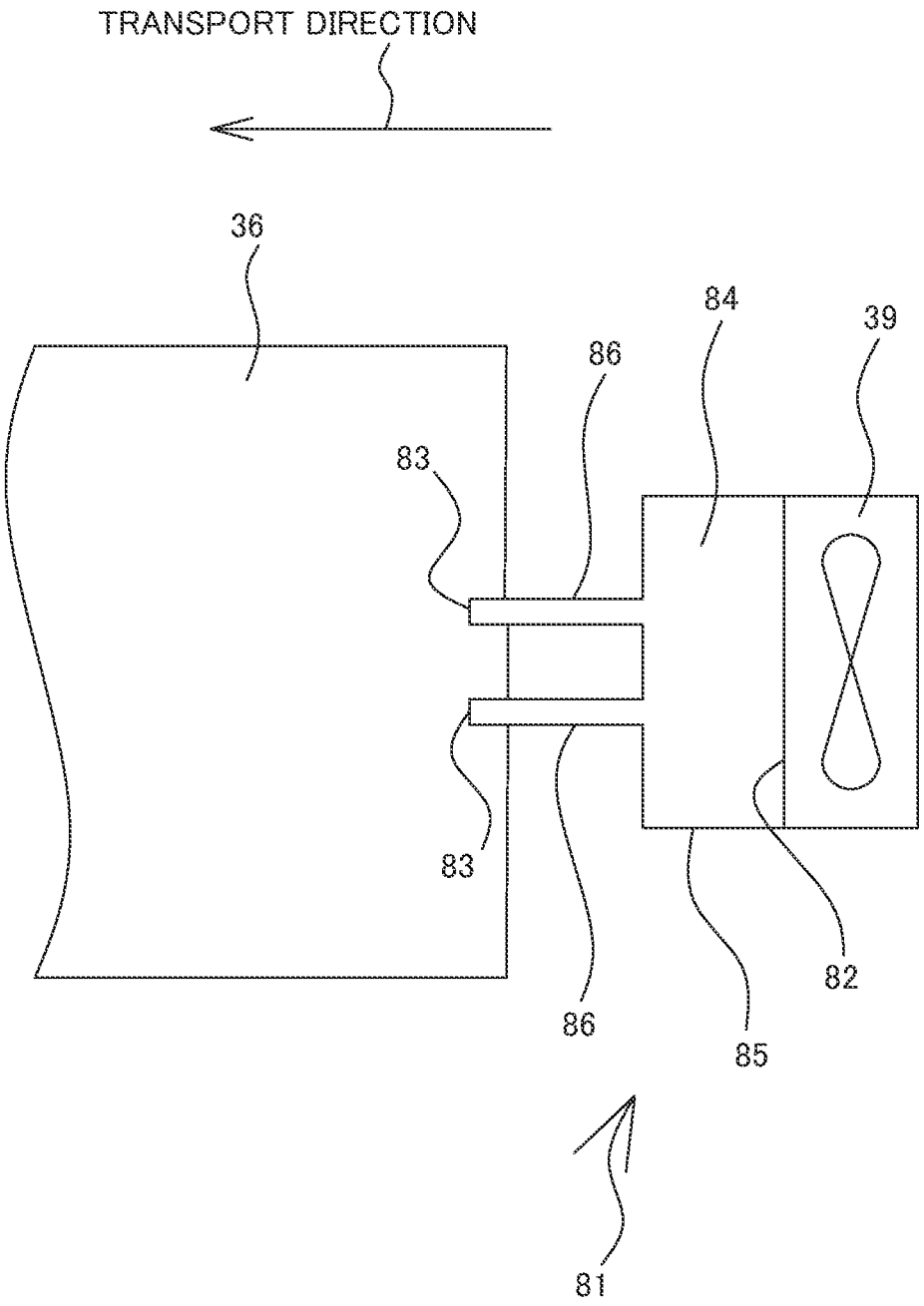
FIG. 4 is a schematic plan view showing a fan and related parts.

FIG. 4 is a schematic plan view showing the fan 39 and the related parts. As shown in FIG. 4, a duct 81 is provided that guides the air emitted from the fan 39 toward the stacking surface of the processing tray 36. The duct 81 includes an air inlet 82 for sucking the air emitted from the fan 39, an air outlet 83 for ejecting the air, and an intermediate passage 84 connecting between the air inlet 82 and the air outlet 83. The intermediate passage 84 includes a main passage portion 85 connected to the air inlet 82, and a sub passage portion 86 branched from the main passage portion 85 and connecting between the main passage portion 85 and the air outlet 83. The sub passage portion 86 is smaller in cross-sectional area for emitting the air, than the main passage portion 85. The portion in the intermediate passage 84 communicating with the air outlet 83 (i.e., sub passage portion 86) extends parallel to the transport direction of the recording sheet P (longitudinal direction orthogonal to the width direction).

Hereunder, a configuration related to the control operation of the image forming apparatus 10 and the postprocessing device 20 will be described. FIG. 5 is a functional block diagram schematically showing an essential internal configuration of the image forming apparatus 10 and the postprocessing device 20, constituting the image forming system 100. As shown in FIG. 5, the image forming apparatus 10 includes the image reading device 11, the image forming device 12, a display device 61, an operation device 62, a touch panel 63, a storage device 64, the controller 66, and an interface (I/F) 67. The mentioned components are configured to transmit and receive data and signals to and from each other, via a bus.

The display device 61 is, for example, constituted of a liquid crystal display (LCD) or an organic light-emitting diode (OLED) display. The operation device 62 includes physical keys such as a tenkey, an enter key, and a start key. The operation device 62 receives inputs of various instructions, corresponding to the user's operation performed on the mentioned keys.

A touch panel 63 is overlaid on the screen of the display device 61. The touch panel 63 is based on a resistive film or electrostatic capacitance. The touch panel 63 detects a contact (touch) of the user's finger made thereon, along with the touched position, and outputs a detection signal indicating the coordinate of the touched position, to the control device 66.

The storage device 64 is a large-capacity storage device such as a solid-state drive (SSD) or a hard disk drive (HDD). The storage device 64 contains various application programs and various types of data.

The controller 66 includes a processor, a random-access memory (RAM), a read-only memory (ROM), and so forth. The processor is, for example, a central processing unit (CPU), an application specific integrated circuit (ASIC), or a micro processing unit (MPU). The controller 66 serves as a processing device that executes the control program stored in the ROM or the storage device 64, thereby executing various processings necessary for the image forming job by the image forming apparatus 10.

The controller 66 is connected to the image reading device 11, the image forming device 12, the display device 61, the operation device 62, the touch panel 63, the storage device 64, and the I/F 67. The controller 66 controls the operation of the components cited above, and transmits and receives signals and data to and from those components.

For example, the controller 66 controls the displaying operation of the display device 61. The controller 66 receives the instruction inputted by the user, on the basis of the detection signal outputted from the touch panel 63 or a press of the physical key on the operation device 62. For example, the controller 66 receives the instruction according to a touch operation, performed through the touch panel 63 on the graphical user interface (GUI) displayed on the screen of the display device 61.

The postprocessing device 20 includes the fan 39, the sheet sensor 40, the first driver 71 to a fourth driver 74, the drive controller 76, and an I/F 77. These components are configured to transmit and receive data and signals to and from each other, via a bus.

The drive controller 76 includes a processor, a RAM, a ROM, and so forth. The processor is, for example, a central processing unit (CPU), an application specific integrated circuit (ASIC), or a micro processing unit (MPU). The drive controller 76 serves as a processing device that executes the drive control program stored in the ROM, thereby executing various operations necessary for the postprocessing by the postprocessing device 20.

The controller 66 of the image forming apparatus 10 and the drive controller 76 of the postprocessing device 20 are configured to input and output data and signals between each other, via the respective I/Fs 67 and 77. For example, the controller 66 of the image forming apparatus 10 outputs a control signal for instructing the postprocessing device 20 to perform the postprocessing, to the drive controller 76 of the postprocessing device 20. The drive controller 76 of the postprocessing device 20 controls the fan 39, the first driver 71, and the second driver 72, according to the control signal received.

The first driver 71 and the second driver 72 of the postprocessing device 20 each include, for example, a stepping motor serving as the drive source. As already described, for example the first driver 71 includes the drive source for moving the blade 37. Likewise, the second driver 72 includes the drive source for rotating the drive roller 42.

The drive controller 76 controls the action of the motor of the first driver 71, thereby causing the blade 37 to vertically reciprocate, with respect to the recording sheet P placed on the processing tray 36. The drive controller 76 controls the action of the motor of the second driver 72, so as to cause the drive roller 42 to rotate clockwise or counterclockwise, thereby causing the moving belt 44 to revolve. With such operation, the moving belt 44 can push up the recording sheet P placed on the processing tray 36 to the upstream side in the transport direction, and move the recording sheet P2 to the downstream side in the transport direction.

Figure 6:
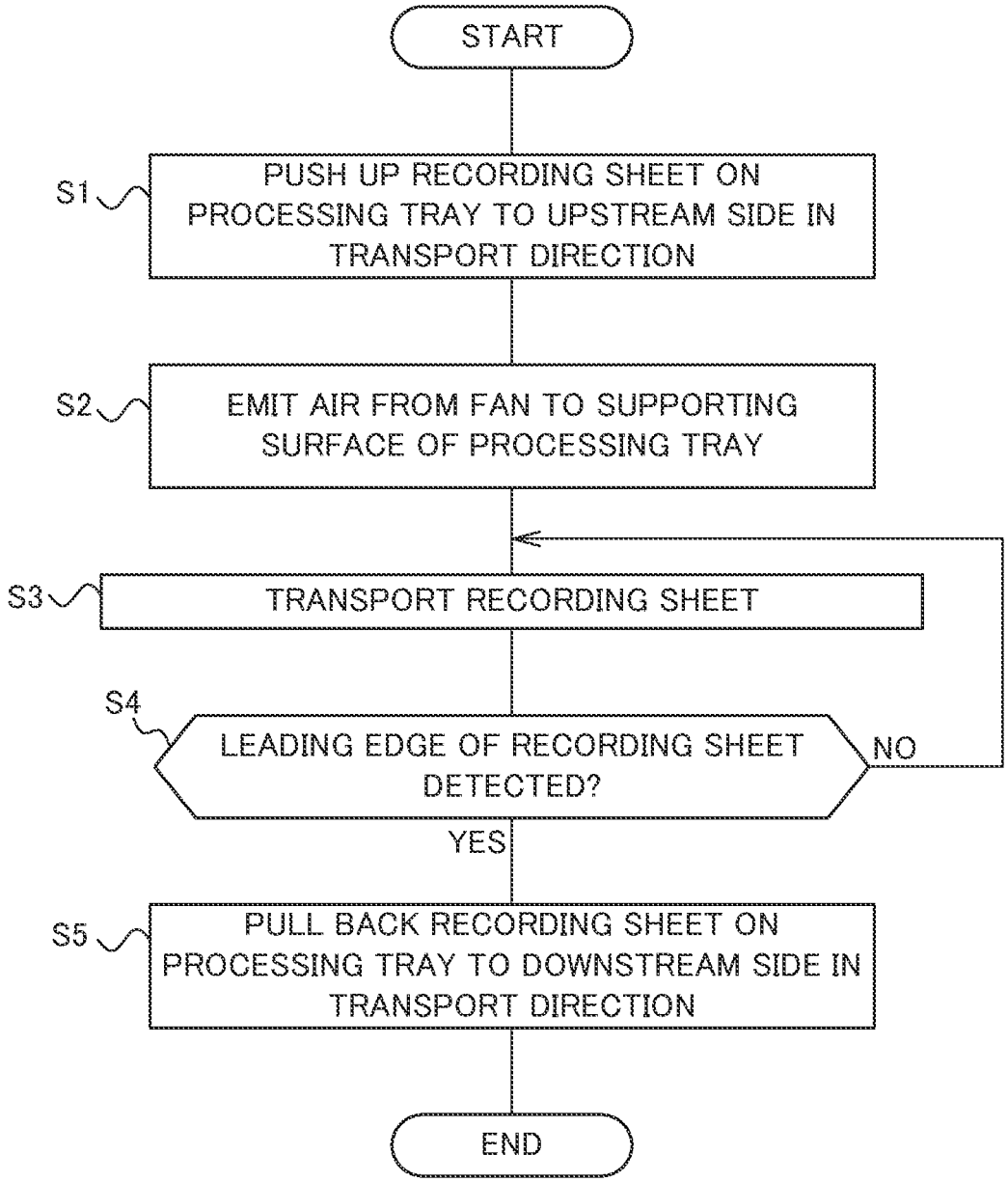
FIG. 6 is a flowchart showing a process of placing the recording sheet.

Referring now to a flowchart shown in FIG. 6, a control operation performed by the drive controller 76 of the postprocessing device 20, to place the recording sheet P on the processing tray 36 in the lower area of the device, will be described hereunder.

Upon receipt of an instruction to execute the inward folding operation, according to the user's operation performed on the start key of the operation device 62, the controller 66 of the image forming apparatus 10 outputs a control signal indicating the instruction to execute the inward folding operation, to the postprocessing device 20 through the I/F 67.

Upon receipt of the control signal indicating the instruction to execute the inward folding operation, through the I/F 77, the drive controller 76 of the postprocessing device 20 controls the second driver 72 so as to cause the drive roller 42 to rotate clockwise in FIG. 3A thus to cause the moving belt 44 to revolve clockwise, thereby pushing up the recording sheet P placed on the processing tray 36 to the upstream side in the transport direction, as shown in FIG. 3A (step S1). Here, since no recording sheet is placed on the processing tray 36, when the first recording sheet P is transported, the operation of step S1 may be started when the second recording sheet P is about to be transported.

The drive controller 76 controls the fan 39, so as to emit the air from the fan 39 to the stacking surface of the processing tray 36 (step S2). The drive controller 76 controls the respective drive sources of the transport roller pairs 31 to 33, so as to transport the recording sheet P delivered from the image forming apparatus 10, through the fourth transport route 52 (step S3). Upon deciding that the recording sheet P1 has been discharged from the fourth transport route 52, and the leading edge of the recording sheet P1 has passed the position under the sheet sensor 40, according to the detection output from the sheet sensor 40 (YES at step S4), the drive controller 76 controls the second driver 72, so as to cause the drive roller 42 to rotate counterclockwise in FIG. 3B thus to cause the moving belt 44 to revolve counterclockwise, thereby pulling back the recording sheet P placed on the processing tray 36 to the downstream side in the transport direction, as shown in FIG. 3B (step S5).

The drive controller 76 repeats the operation of step S1 to step S5, until a prespecified number of recording sheets P are all stacked on the processing tray 36. When the prespecified number of recording sheets P are all stacked on the processing tray 36, the drive controller 76 controls the moving belt 44, the blade 37, and the folding roller 38 by known control methods, so as to inwardly fold the sheaf of the recording sheet P, and deliver the folded sheaf of the recording sheets P to the output tray 35.

Now, since a plurality of recording sheets P are stacked on the processing tray 36, the upper face of the recording sheet P2 already placed on the processing tray 36, and the lower face of the recording sheet P1 being newly placed enter into contact with each other, during the transport operation of the recording sheets P. Such a contact may impede the recording sheet P from proceeding further, or cause the recording sheet P to bounce, because of the friction between the recording sheets P, which may lead to failure in properly placing the recording sheets P on the processing tray 36. In particular, the recording sheets P subjected to the ink jet printing operation are often transported in a wet state, with the ink undried yet, and therefore the frictional force between the recording sheets P is increased.

Although the aforementioned known postprocessing device can reduce the friction arising from the contact, it takes a longer time before the recording sheet P is placed on the processing tray, and therefore the productivity is lowered.

With the configuration according to the foregoing embodiment, in contrast, the air emitted from the fan 39 forms the air layer, between the upper face of the recording sheet P2 already placed on the stacking surface of the processing tray 36, and the lower face of the recording sheet P1 newly placed on the processing tray 36.

Without such air layer, for example, the leading edge of the recording sheet P1 delivered through the transport roller 33 to be newly placed on the processing tray 36 makes contact with the upper face of the recording sheet P2 already placed on the processing tray 36. In this case, the recording sheet P1 is bent in the region between the leading edge thereof and the exit 521 of the transport route 331, and the upper face of the recording sheet P2 already placed on the processing tray 36 is biased to the downstream side in the transport direction, by the leading edge of the recording sheet P1, owing to the restoring force (stiffness) of the recording sheet P1 to recover from the bent state. As result, the stacking status of the sheaf of the recording sheets P2 may become irregular, or the recording sheet P1 may fail to be properly placed on the sheaf of the recording sheets P2.

However, the air layer formed by the air emitted from the fan 39, as in the foregoing embodiment, serves to mitigate the extent of the bending of the recording sheet P1, delivered through the transport roller 33 to be newly placed on the processing tray 36, when the leading edge thereof is about to contact the upper face of the recording sheet P2 already placed on the processing tray 36. Accordingly, the biasing force exerted by the leading edge of the recording sheet P1, attempting to move the upper face of the recording sheet P2 to the downstream side in the transport direction, can be minimized. Therefore, the recording sheet P1 can be placed on the recording sheet P2, with reduced chance that the upper face of the recording sheet P2 and the lower face of the recording sheet P1 make contact with each other. As result, the friction arising from the contact can be reduced, and the recording sheets P stacked on the processing tray 36 can be properly aligned, which leads to minimized degradation in productivity.

According to the foregoing embodiment, the portion of the duct 81 communicating with the air outlet 83 (sub passage portion 86) extends parallel to the transport direction of the recording sheet P (longitudinal direction orthogonal to the width direction), as shown in FIG. 4. Such a configuration enables the air emitted from the fan 39 to hit the recording sheet P placed on the processing tray 36, in the direction parallel to the longitudinal direction of the recording sheet P. Therefore, the recording sheet P can be prevented from being displaced in the transport direction or in the width direction.

According to the foregoing embodiment, further, the air outlet 83 of the duct 81 is located at the position where the trailing edge of the recording sheet P2 is exempted from being directly hit by the air from the fan 39, when the recording sheet P2 already placed on the processing tray 36 is moved to the upstream side in the transport direction, and the next recording sheet P1 is about to be placed on the processing tray 36. Such a position corresponds, for example, to the position downstream of the trailing edge of the recording sheet P2 in the transport direction, and higher than the upper surface of the uppermost sheet of the maximum number of recording sheets P that the processing tray 36 can accept. Such a configuration prevents the trailing edge of the recording sheet P from being lifted up by the air from the fan 39.

When the recording sheet P loses rigidity (becomes less stiff) owing to moisture, the posture of the recording sheet P becomes unstable, which may affect the transport performance. However, the recording sheet P can be subjected to the wind pressure generated by the air from the fan 39 in the foregoing embodiment, thus to be facilitated to maintain the correct posture. Therefore, when delivering the recording sheet P to the processing tray 36, it is preferable to activate the fan 39 to emit the air, even though no recording sheet P is placed on the processing tray 36 yet.

As another embodiment, the drive controller 76 may change the drive control of the fan 39, on the basis of predetermined information related to the printing operation, or the instruction from the user related to the printing operation. The predetermined information may include, for example, print coverage, the type of the sheet, and the printing method.

When the print coverage is low, or when the sheet is thick, the rigidity of the recording sheet P is barely lowered. Accordingly, upon deciding that the print coverage is equal to or lower than a predetermined first threshold, or that the thickness of the sheet is equal to or thicker than a predetermined second threshold, on the basis of the predetermined information transmitted from the image forming apparatus 10, the drive controller 76 may keep from activating the fan 39, or reduce the number of rotations of the fan 39 per unit time (that is, rotational speed) by a predetermined value, thereby reducing the air volume from the fan 39.

When the image is formed by electrophotography, using a developing agent such as a toner, the recording sheet P becomes less wet, compared with the case of the ink jet printing, and therefore the rigidity of the recording sheet P is barely lowered. Accordingly, the drive controller 76 may keep from activating the fan 39, for example when a signal indicating that the printing method is the electrophotography is received from the image forming apparatus 10, as the predetermined information, but may activate the fan 39, when a signal indicating that the printing method is the ink jet printing is received from the image forming apparatus 10, as the predetermined information.

Further, for example when the user inputs a first instruction for cancelling the operation of the fan 39, through the operation device 62, the image forming apparatus 10 transmits a signal representing the first instruction, to the postprocessing device 20. When the postprocessing device 20 receives the signal representing the first instruction, the drive controller 76 may keep from activating the fan 39. In addition, when the user inputs a second instruction for degrading the performance of the fan 39, through the operation device 62, the image forming apparatus 10 transmits a signal representing the second instruction, to the postprocessing device 20. When the postprocessing device 20 receives the signal representing the second instruction, the drive controller 76 may reduce the number of rotations of the fan 39 per unit time by a predetermined value, thereby reducing the air volume from the fan 39.

The disclosure is not limited to the configuration according to the foregoing embodiment, but may be modified in various manners. For example, although the disclosure is applied to the processing tray 36 for performing the inward folding operation in the embodiment, the disclosure may be applied to a processing tray for performing a different postprocessing, such as the stapling operation.

Further, the configurations and processings described in the foregoing embodiment and variations with reference to FIG. 1 to FIG. 6 are merely exemplary, and in no way intended to limit the disclosure to those configurations and processings.

While the present disclosure has been described in detail with reference to the embodiments thereof, it would be apparent to those skilled in the art the various changes and modifications may be made therein within the scope defined by the appended claims.

What is claimed is:

1. A postprocessing device to be attached to an image forming apparatus, the postprocessing device comprising:

a processing tray for stacking thereon sheets on which an image has been formed, and which is transported from the image forming apparatus;

a sheet processor that performs predetermined postprocessing on the sheets stacked on the processing tray;

a fan that forms an air layer between an upper face of the sheets already stacked on a stacking surface of the processing tray and a lower face of a sheet newly placed on the processing tray, by emitting air in a transport direction of the sheet, from an upstream side in the transport direction toward the stacking surface; and a duct that guides the air emitted from the fan toward the stacking surface, wherein the duct includes an air inlet for sucking the air emitted from the fan, a plurality of air outlets for ejecting the air, and an intermediate passage connecting between the air inlet and the plurality of air outlets, and the intermediate passage includes a main passage portion connected to the air inlet, and a plurality of sub passage portions connecting between the main passage portion and each of the plurality of air outlets, and each of the plurality of sub passage portions is smaller in cross-sectional area for emitting the air than the main passage portion, and extends parallel to the transport direction of the sheet, wherein the postprocessing device further comprising a drive controller configured to control an action of the fan, by executing a control program, and the drive controller is configured to change drive control of the fan, on a basis of predetermined information related to a printing operation by the image forming apparatus, or an instruction from a user related to the printing operation, wherein the postprocessing device further comprising an interface device that communicates with the image forming apparatus, the drive controller keeps from activating the fan, when a signal indicating that the printing method is the electrophotography, as the predetermined information, is received from the image forming apparatus via the interface device, and the drive controller activates the fan, when a signal indicating that the printing method is the ink jet printing, as the predetermined information, is received from the image forming apparatus via the interface device.

2. The postprocessing device according to claim 1, wherein the processing tray is located at a position that exempts a trailing edge of the sheets stacked on the stacking surface from being directly hit by the air emitted from the fan.

3. The postprocessing device according to claim 1, wherein the plurality of air outlets are located at a position higher than an upper surface of an uppermost sheet of the sheets, in a case where a maximum number of sheets that the sheet processor can accept are stacked on the processing tray.

4. A postprocessing device to be attached to an image forming apparatus, the postprocessing device comprising:

a processing tray for stacking thereon sheets on which an image has been formed, and which is transported from the image forming apparatus;

a sheet processor that performs predetermined postprocessing on the sheets stacked on the processing tray;

a fan that forms an air layer between an upper face of the sheets already stacked on a stacking surface of the processing tray and a lower face of a sheet newly placed on the processing tray, by emitting air in a transport direction of the sheet, from an upstream side in the transport direction toward the stacking surface; and a drive controller configured to control an action of the fan, by executing a control program, wherein the drive controller is configured to change drive control of the fan, on a basis of predetermined information related to a printing operation by the image forming apparatus, or an instruction from a user related to the printing operation, wherein the predetermined information includes a print coverage and a thickness of the sheet, and the drive controller keeps from activating the fan, or reduces a rotational speed by a predetermined value, when the print coverage is equal to or lower than a predetermined first threshold, or when the thickness of the sheet is equal to or thicker than a predetermined second threshold.

5. An image forming system comprising:

an image forming apparatus that forms an image on a sheet; and a postprocessing device according to claim 4.

* * * * *